United States Patent [19]

Rosendale

[11] Patent Number: 4,641,757

[45] Date of Patent: Feb. 10, 1987

[54] CIRCULATING LATCH TRANSPORT MECHANISM FOR OVERHEAD CRANES

[75] Inventor: John V. Rosendale, Hampton, Va.

[73] Assignee: Robotic Systems, Inc., Hampton, Va.

[21] Appl. No.: 492,268

[22] Filed: May 6, 1983

[51] Int. Cl.[4] ..... B66C 19/00

[52] U.S. Cl. ..... 212/205; 212/271; 105/177; 104/182

[58] Field of Search ..... 180/901, 902, 164, 9.44; 305/8; 104/89, 182; 105/177; 212/149, 153, 159, 160, 205–221, 271

[56] References Cited

U.S. PATENT DOCUMENTS

| | | | |
|---|---|---|---|
| 1,053,545 | 2/1913 | Steedman | 104/98 |
| 2,734,463 | 2/1956 | Hursh et al. | 105/177 |
| 2,768,697 | 10/1956 | Shotwell | 180/2 |
| 2,889,597 | 6/1959 | Griffiths | 105/177 |
| 3,200,770 | 8/1965 | Hendry | 305/8 |
| 3,398,806 | 8/1968 | Hendricks | 180/2 |
| 3,960,229 | 6/1976 | Shio | 180/1 |
| 3,961,712 | 6/1976 | Bartley | 212/210 |
| 4,352,330 | 10/1982 | Tupper | 104/182 |
| 4,459,916 | 7/1984 | Tupper | 104/182 |
| 4,461,216 | 7/1984 | Carney | 104/89 |

*Primary Examiner*—Trygve M. Blix
*Assistant Examiner*—Stephen P. Avila
*Attorney, Agent, or Firm*—Sandler & Greenblum

[57] ABSTRACT

A circulating latch transport mechanism is provided which is capable of moving freely in any direction across the under side of a horizontal array of parallel I-beams while remaining attached to this array. The transport mechanism is attached simultaneously to several I-beams, which allows the mechanism to move across a ceiling in a longitudinal direction with respect to the I-beams, a direction perpendicular or transverse to the I-beams, and, by the mechanical independent actions of the longitudinal and perpendicular motions, in an arbitrary direction.

24 Claims, 10 Drawing Figures

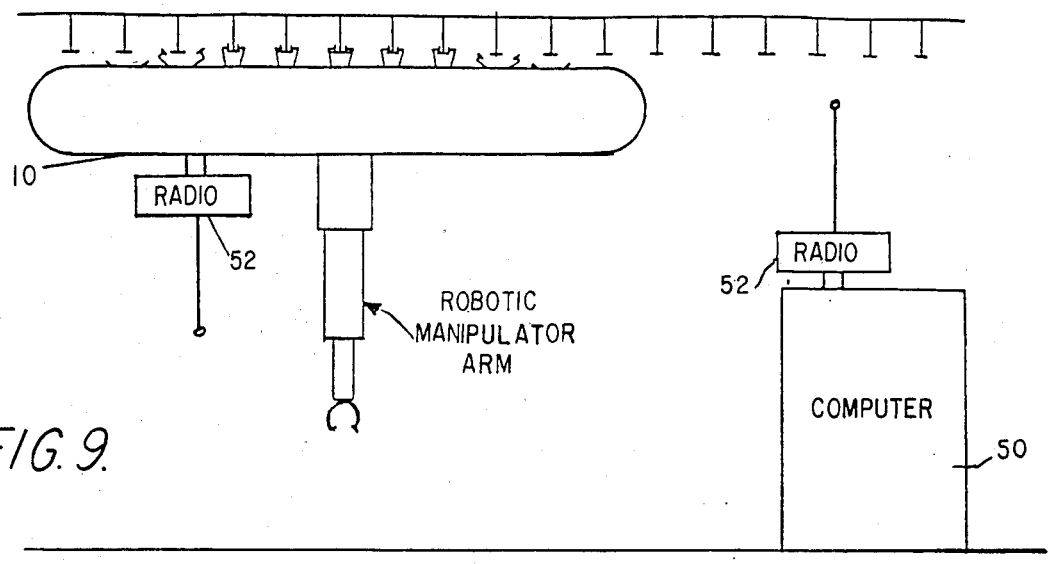
FIG. 9.
FIG. 10.
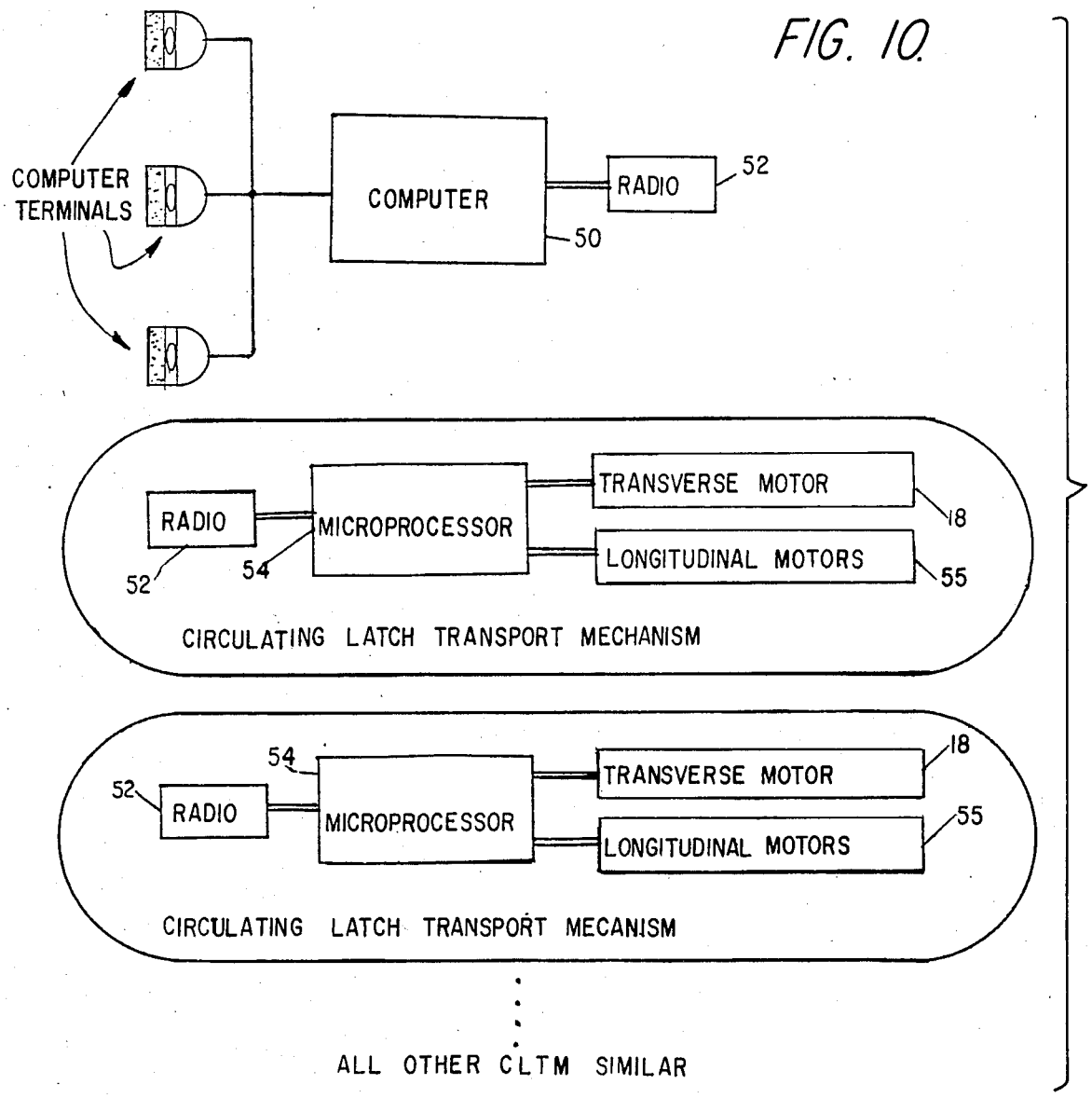

CIRCULATING LATCH TRANSPORT MECHANISM FOR OVERHEAD CRANES

BACKGROUND OF THE INVENTION

1. Field of the Invention

The present invention relates generally to a transport mechanism, and more particularly to a circulating latch transport mechanism which permits motion in two dimensions on a planar array of parallel ceiling beams while maintaining firm mechanical attachment to the beam structure.

2. Discussion of Prior Art

Currently there are a variety of materials handling systems which are flexible in the sense that a variety of paths and destinations for the cargo may be selected, and a variety of cargos may be transported. For example, forklift trucks can carry a variety of palletized cargo and can transport this cargo anywhere ina warehouse or manufacturing complex. By contrast, conveyor belt systems are usually much more specialized and inflexible.

Some examples of prior art mobile handling systems are shown in the following references.

HENDRICKS, U.S. Pat. No. 3,398,806, discloses a self-propelled construction-type mobile platform which carries objects over corrugated or ribbed supporting surfaces.

SHIO, U.S. Pat. No. 3,960,229, discloses a motor-driven vehicle which may be used on flat or inclined surfaces. The vehicle is provided with electromagnetic pads or shoes on continuous tractor belts. As the shoes pass along the bottom of the tractor belts, an electromagnetic force can be generated to prevent the vehicle from falling from an inclined surface. The surface must be magnetizable and is preferably made of steel. A typical use for such a vehicle would be transportation on a ship's hull.

STEEDMAN, U.S. Pat. No. 1,053,545, discloses a crane which is positioned below a bridge and supported by parallel I-beams such that the lower flanges of the I-beams serve as tracks for the wheels of the crane.

Most flexible materials handling systems can be classified as floor-based systems or ceiling-based systems. For example, forklift trucks are flor-based, while overhead cranes may be thought of as ceiling-based. In general, floor-based systems are simpler to operate and more economical, but require a great deal of floor space. Typical floor-based systems also include carts, dollies, towline systems and mobile pallet systems. In the case of mobile pallet systems, the cargo is mounted ona skid or pallet which rests on wheels or a pneumatic cushion. The pallet may be self-propelled or pulled by a tow-cable system. Self-propelled pallets may be computer controlled and may be adapted to follow guide wires embedded in the floor.

The most common overhead or ceiling-based system is the standard overhead crane. Overhead cranes are a preferred method for handling materials since they do not use floor space which can then be allocated for other purposes. However, no current overhead materials handling systems have the flexibility of the motorized pallet systems or of forklift trucks, and most are not easily adaptable to computer control. In addition, it is often the case that more than one overhead crane is operated in the same crane bay in order to speed materials handling. A problem often results when cranes sharing the same bay get in the way of each other. This is known as interference between cranes. In some industries this problem is serious enough to require computer simulations in order to minimize the impact on production.

SUMMARY OF THE INVENTION

It is a general object of the present invention to provide a new and improved transport mechanism for overhead cranes which will overcome the deficiencies of the prior art.

Another object of the present invention is to provide a new and improved transport mechanism for overhead cranes which will oeprate in an area with very little interference between cranes.

A further object of the present invention is to provide a new and improved transport mechanism for overhead cranse capable of motion in longitudinal, transverse and arbitrary directions with respect to an array of parallel ceiling beams.

Still another object of the present invention is to provide a new and improved overhead transport mechanism which is easily adaptable to computer control.

An additional object of the present invention is to provide a mobile computer controlled overhead platform on which robotic manipulator arms may be mounted.

A further object of the present invention is to provide a new and improved overhead transport mechanism which may operate similarly to a conventional forklift truck, but requires no aisles or floor space for operation.

The present invention is provided for by a system of circulating latch transport mechanisms which may be adapted to the ceiling of a building or any overhead space and may operate in an area with very little interference between cranes. To operate the mechanism, the ceiling of a building is provided with an array of parallel equally spaced beams, which can be beams of standard I-beam cross-section. Each transport mechanism attaches simultaneously to several beams. Through mechanical process further described in the specification, each transport mechanism can move freely in a two dimensional direction about the ceiling while remaining attached to the beams. The result is a vehicle which can travel in any direction about the ceiling of a building.

BRIEF DESCRIPTION OF THE DRAWINGS

The above and other objects, features and advantages of the present invention will become more fully apparent to those of ordinary skill in the art to which the present invention pertains from the following detailed description, taken in conjunction with the accompanying drawings in which:

FIG. 9 is a schematic view of a computer controlled CLTM; and

FIG. 10 is a diagrammatical overview of a computer control system for the CLTM.

DETAILED DESCRIPTION OF THE DRAWINGS

The transport mechanism system herein described permits the design of overhead cranes having greater mobility than those of conventional design. The new and improved transport mechanism system circumvents the current problems of interferences between cranes and allows many overhead cranes to operate in the same area with little interference between the cranes.

Figure 1:
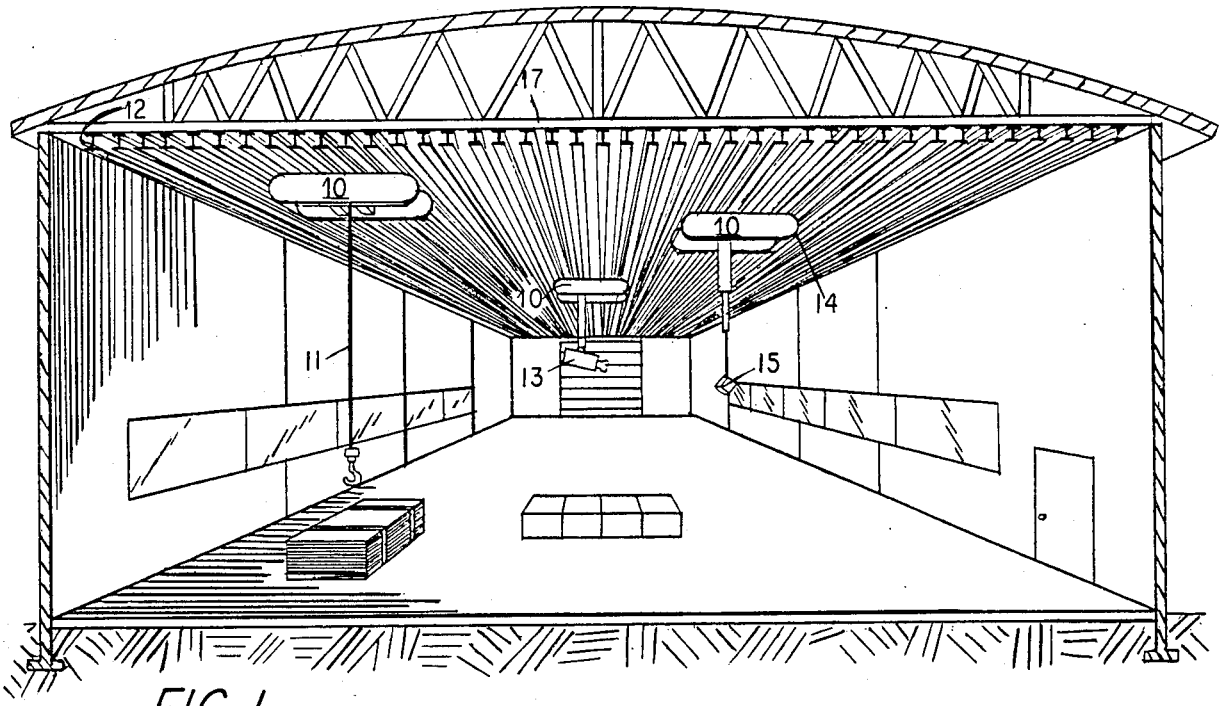
FIG. 1 is a plan view showing several circulating latch transport mechanisms in use in a variety of ways in a warehouse.

Referring now more specifically to FIG. 1, a conventional warehouse is illustrated showing three such CLTM's 10 and their corresponding overhead track system 17. Illustrated in FIG. 1 are representative examples of CLTM's 10 used as a crane 11, a video camera 13, and a mechanical manipulator arm 15. It should be apparent to one with knowledge in the art that crane 11, video camera 13 and arm 15 are only representative illustrations of CLTM's 10 and other uses are well within the contemplation of this invention. Each CLTM 10 is attached to an array of parallel I-beams 12 on the ceiling of the warehouse by a pair of circulating latches 14, which have the shape of an oval. Circulating latches 14 are attached to I-beams 12 by small rollers (further described in the specification) thereby enabling transport mechanism 10 to roll along the tracks formed by the flanges of parallel I-beams 12. This movement is termed "longitudinal motion."

Of particular importance to this invention is the provision for movement of CLTM's 10 across the overhead track system 17 in a direction perpendicular to I-beams 12. This second type of movement, termed "transverse motion", is made possible by circulating latches 14. Briefly, circulating latches 14 operate much like the endless, flexible-type treads on some tractors, rolling across the array of parallel I-beams 12 while remaining attached to overhead track system 17 by CLTM 10. Transverse motion will be described in more detail further in the specification.

Since the directions of the longitudinal and transverse motions of CLTM 10 are perpendicular to each other, CLTM 10 can then move in two-dimensions with respect to the overhead track system 17. In addition, the longitudinal and transverse directions of motion are mechanically independent. Therefore, by combining the two motions, CLTM 10 can move across the ceiling in an arbitrary direction. When more than one CLTM 10 is operated in the same area, as shown in FIG. 1, they operate entirely independent of each other and can move in an arbitrary direction as long as the CLTM's avoid contact with each other. Thus, multiple CLTM-type cranes operating in the same area will only slightly interfere with each other while advantageously covering an entire warehouse area.

Figure 2:
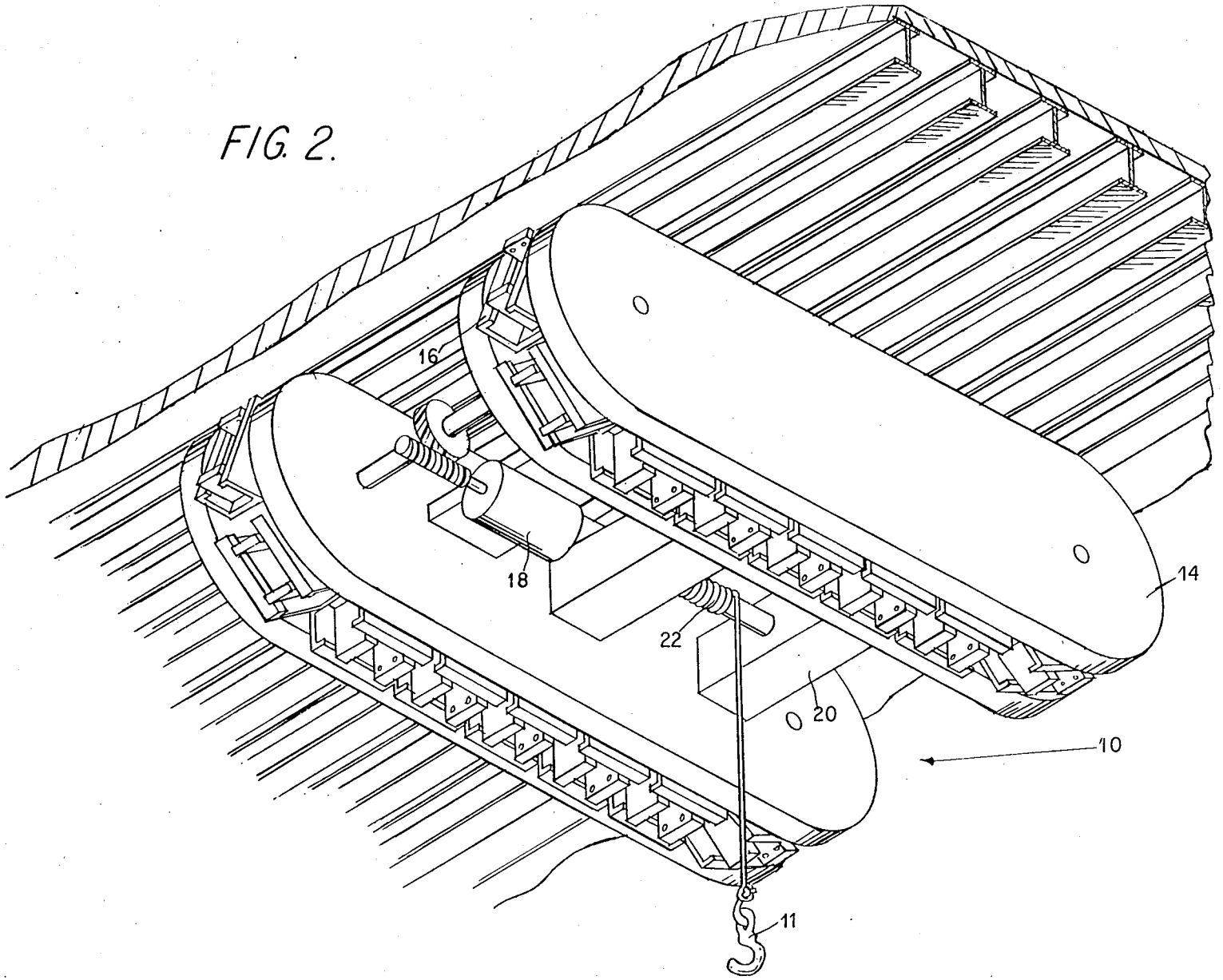
FIG. 2 is an isometric view of one circulating latch transport mechanism (hereinafter referred to as "CLTM")

The oval-shaped circulating latches 14 are shown in greater detail in FIG. 2, which illustrates in detail CLTM 10 designed for use as a crane 11. The eight mechanical objects visible about the perimeter of each circulating latch 14 are trucks 16. Trucks 16 move about the perimeters of circulating latches 14. The space between the two circulating latches 14 is occupied by transverse drive motor 18, support beams 20 which structurally join the two circulating latches 14, and winch 22 for use in crane 11.

Figure 3:
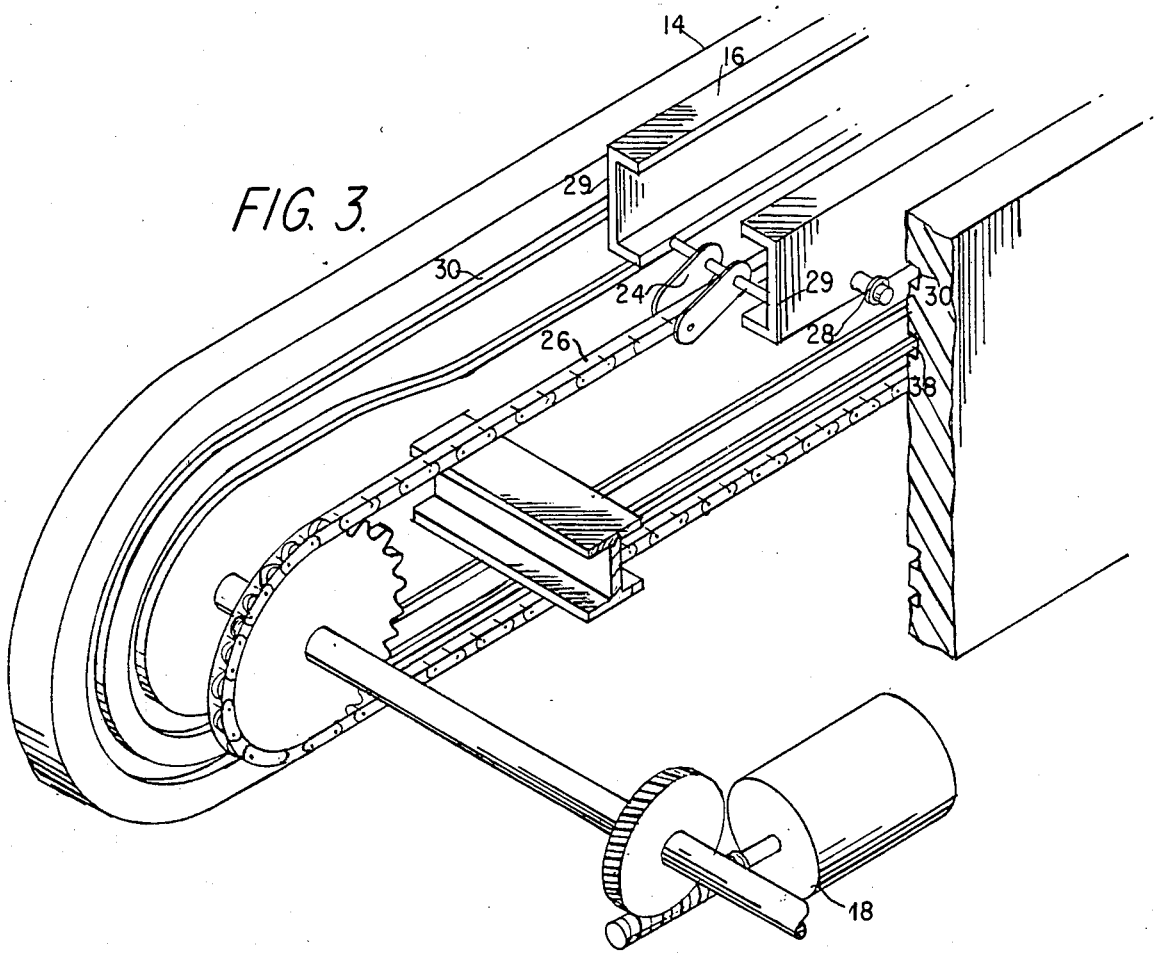
FIG. 3 is a cut-away view of a circulating latch.

FIG. 3 shows in cut-away view circulating latch 14. The near side of circulating latch 14 has been partially removed from the drawing, and all but one truck 16 have been omitted to reveal the interior detail of the latch 14. Truck 16 comrpises tongue 24 for purposes of attachment to drive chain 26. Trucks which are omitted from the drawing would be similarly attached to drive chain 26 at equal intervals along the chain 26. Truck 16 has four small wheels 28, two wheels on each side of walls 29, designed to ride within main races 30. In operation, the transverse drive motor 18 turns drive chain 26, which moves truck 16 about main races 30. CLTM 10 contains only one transverse drive motor 18 for both circulating latches 14. However, every truck 16 carries a separate longitudinal drive motor (not shown).

Figure 4:
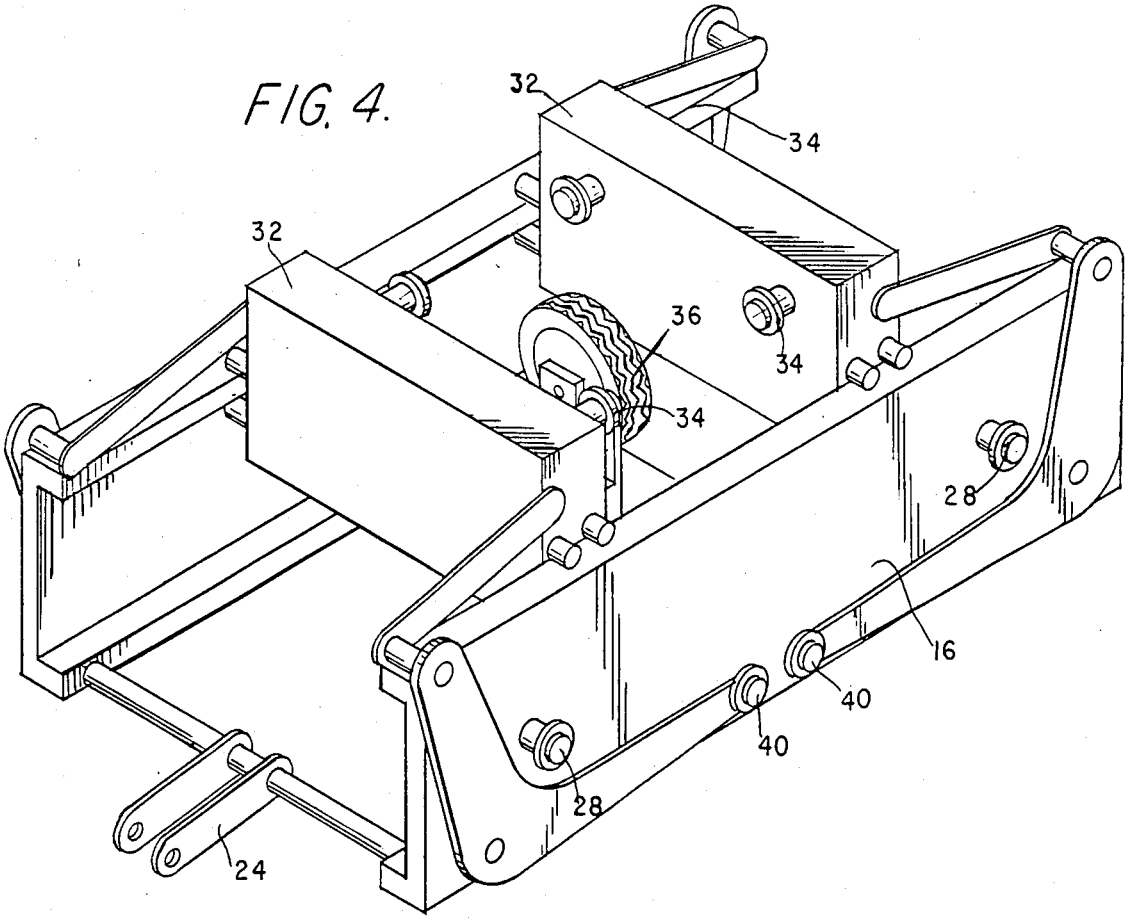
FIG. 4 is a detailed drawing of a truck, one of the components of the CLTM.
Figure 5:
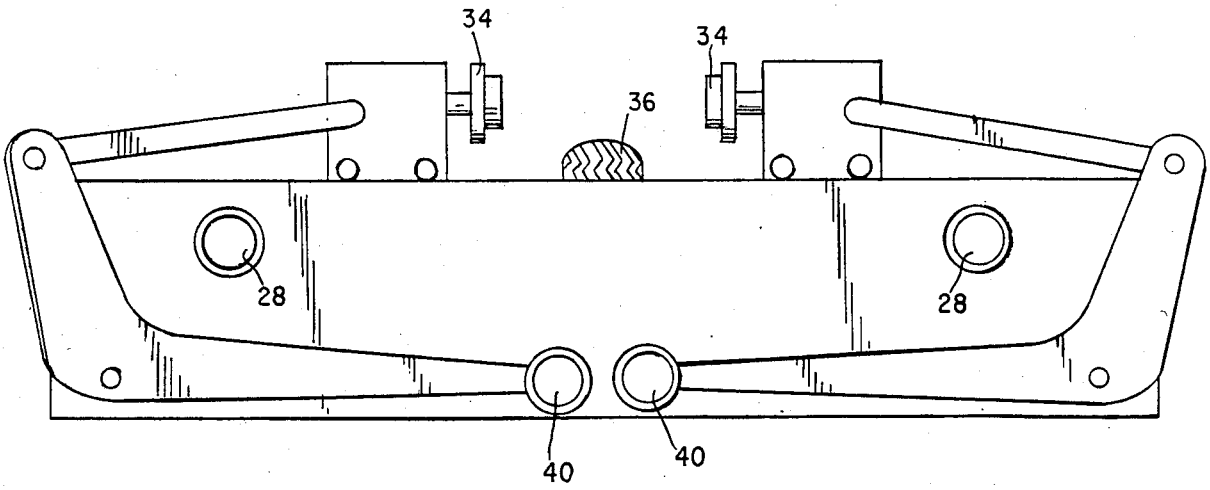
FIG. 5 is a detailed drawing of the side view of the truck of FIG. 4 showing the truck's jaws in the open position.

Shown in FIG. 4 are truck 16, tongue 24, described above, and wheels 28 which ride in main races 30. This Figure details the structure of jaws 32 and the actuator mechanisms. The operation of jaws 32 and the actuator mechanisms are further detailed in FIGS. 5 and 6, where the open and closed positions of jaws 32 are illustrated.

Figure 6:
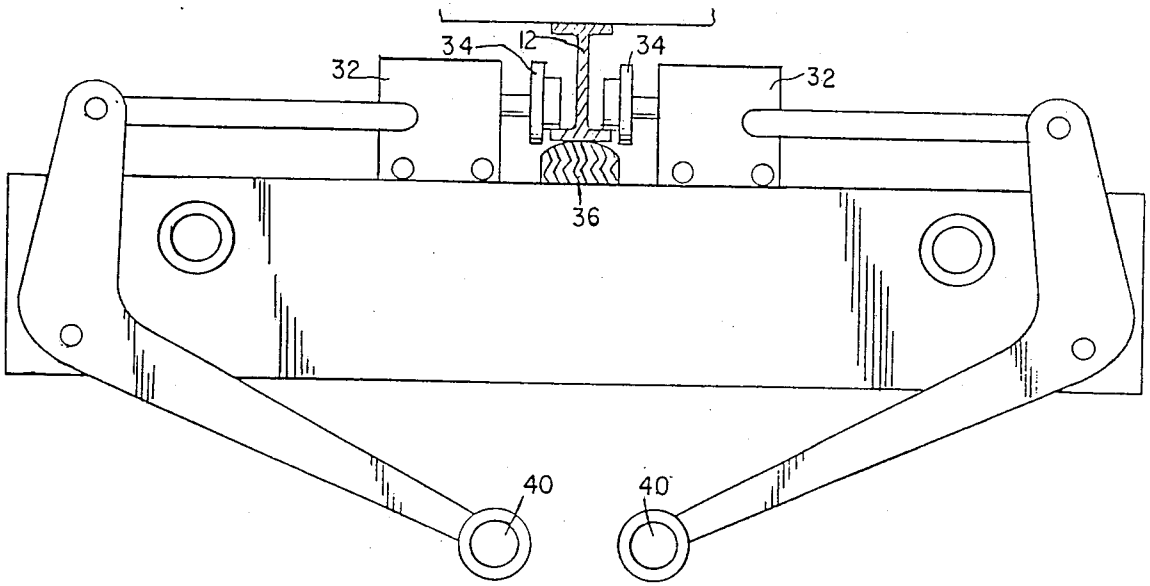
FIG. 6 is a side view of the truck of FIGS. 4 and 5 showing the jaws in the closed position.
Figure 7:
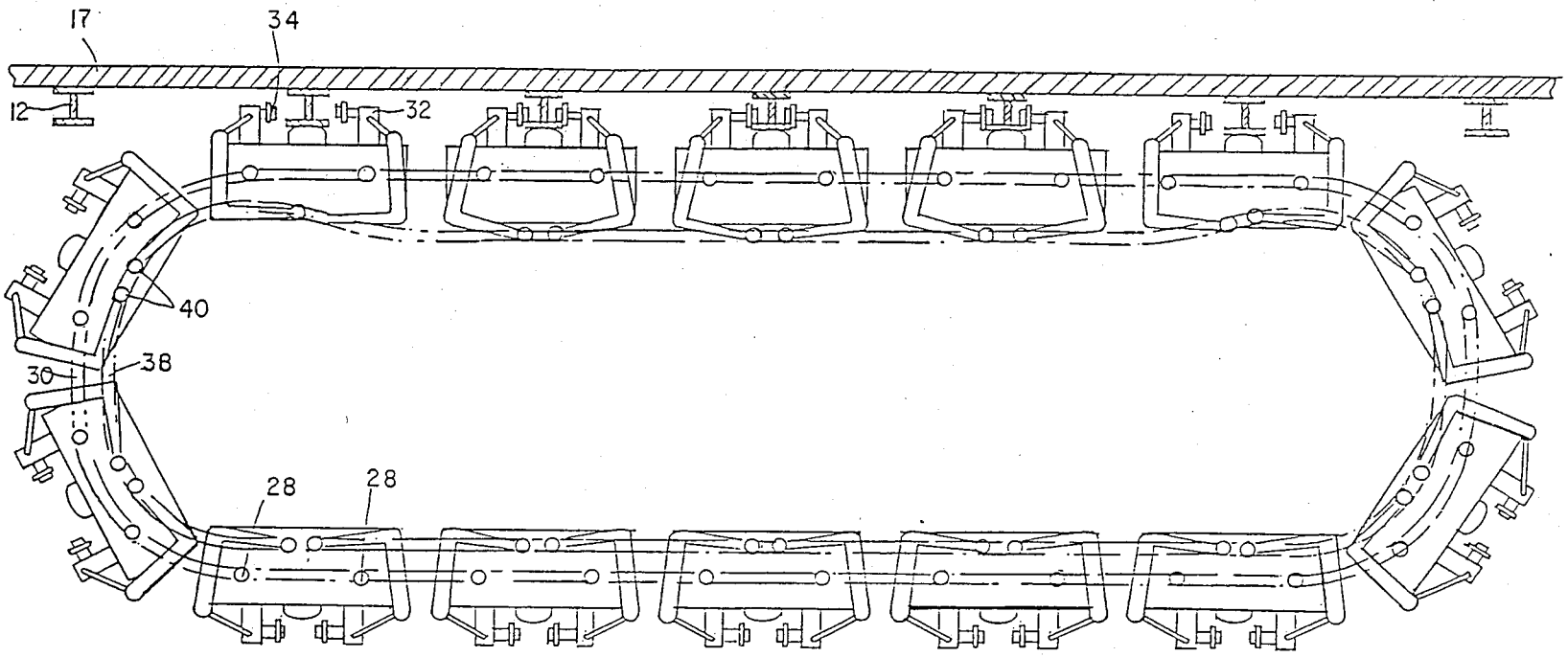
FIG. 7 is a shcematic view showing the cam system in the circulating latch of the transport mechanism.

Trucks 16 are attached to I-beams 12 of overhead track system 17 by means of jaws 32, as shown in FIG. 6. When several of trucks 16 in each circulating latch 14 are attached to I-beams 12, circulating latches 14, and therefore CLTM 10, will be attached to the overhead track system 17 on a ceiling as shown in FIG. 7. In FIG. 6, trucks 16 contact I-beams 12 with rollers 34 which are situated inside jaws 32. Rollers 34 allow CLTM 10 to roll along I-beams 12. Thus, the "longitudinal" motion of CLTM 10 is achieved. By motorizing drive tire 36, shown in FIGS. 4, 5 and 6, this longitudinal motion can be powered. Truck 16 requires a separate motor (not shown) connected to drive tire 36.

FIG. 7 is designed to illustrate the motion of CLTM 10 in a transverse direction. In order to move in the transverse direction, transverse drive motor 18 (shown in FIG. 2) turns drive chain 26 which correspondingly moves truck 16 about main races 30 of circulating latch 14. As shown in FIG. 7, there must always be some turcks 16 with their corresponding jaws 32 clamped onto I-beams 12 in order to insure that CLTM 10 remains attached to overhead track system 17.

In order for CLTM 10 to move in a transverse direction, jaws 32 of trucks 16 must be in a position to receive I-beam 12 as trucks 16 move about the circulating latches 14. One way of insuring proper operation of jaws 32 is to use a cam system. As shown in FIGS. 3 and 7, cam races 38 are positioned inside main races 30. Cam follower rollers 40 follow the path created by cam races 38. This cam system operates jaws 32, opening and closing them as trucks 16 move about circulating latches 14. At any instant, some of trucks 16 will be situated in positions where main races 30 and cam races 38 are close together and jaws 32 will be open. Trucks 16 which are at the locations where the two races 30 and 38 are situated farther apart have their jaws 32 closed. This is shown in FIG. 7. Because of the shape of the track of cam races 38, most of trucks 16 will have their jaws 32 open at any instant. In particular, trucks 16 on the curved portions of main races 30 have jaws 32 open as required. But those along the upper straight portions of main races 30, where the main and cam races 30 and 38 are more widely spaced, will have closed jaws 32. At this point, trucks 16 are clamped to I-beams 12 thereby securely attaching CLTM 10 to the overhead track system 17. It should be known to one with knowledge in the art that the cam system is but one of several systems which can be used for this operation. The cam system is presented here for illustration purposes only. Other systems, such as an electrical or hydraulic servo system may also be used.

The transverse motion of CLTM 10 is perhaps easiest to visualize by analogizing the system to an inverted tractor which consists of an endless, flexible track system. CLTM 10 moves across I-beams 12, just as such a tractor rides across the ground. The major difference of course is that gravity will not hold CLTM 10 to overhead track system 17 thus requiring the jaw and cam actuator mechanisms.

The circulating latch transport mechanism described herein is capable of moving freely in any direction across the underside of a horizontal array of I-beams while remaining attached to this array. In addition, the transport mechanism is capable of supporting and transporting loads from one area to another. The transport mechanism may be applied to industrial automation, storage and retrieval systems and to robotics. The natural orthogonal decomposition of its motion into transverse and longitudinal motion is an attractive feature of the CLTM. This feature and the ease with which precise position indexing can be incorporated will considerably simplify computer system controls in such transport mechanisms.

Figure 8:
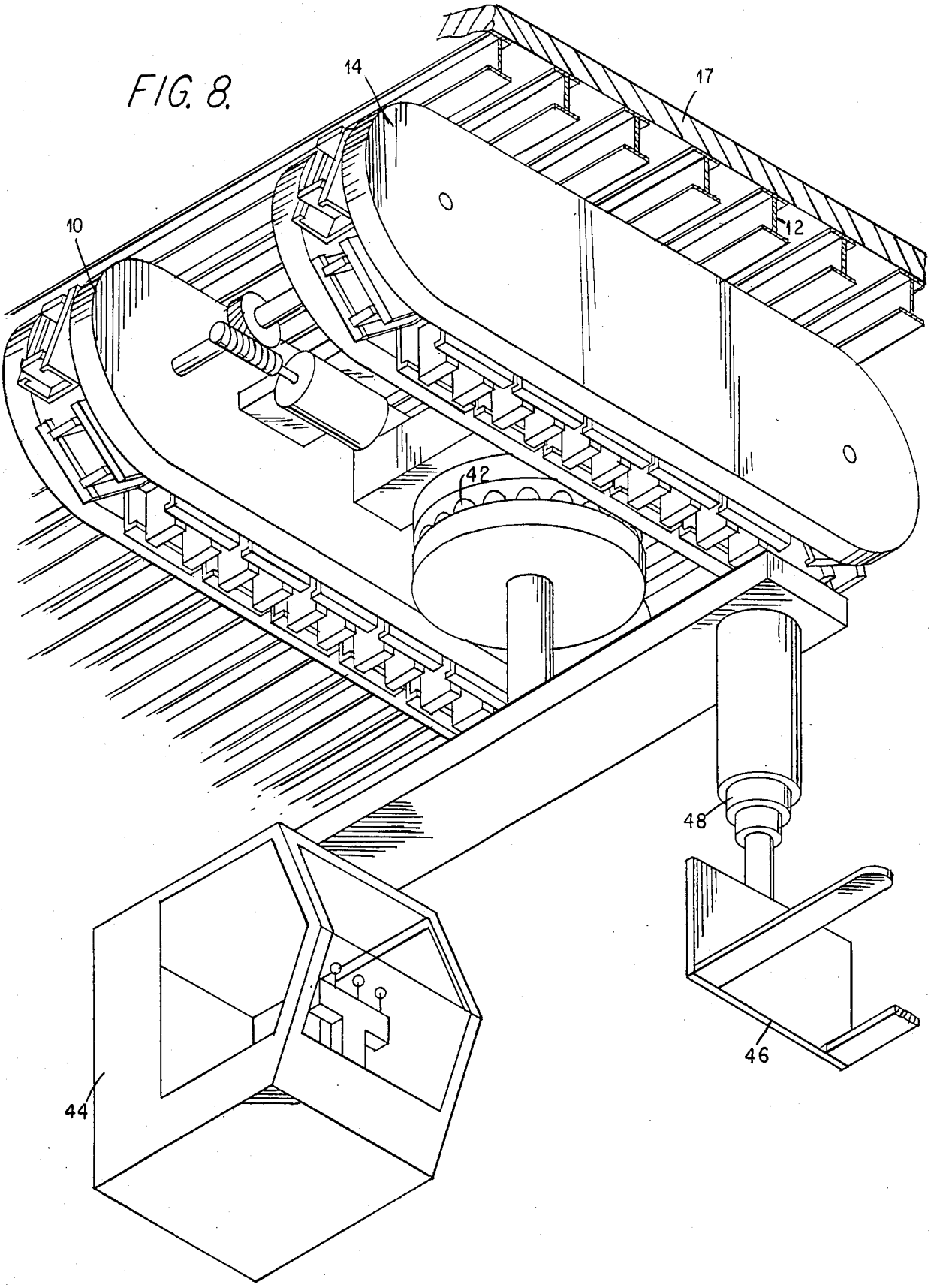
FIG. 8 illustrates an embodiment of the transport mechanism adapted to an overhead forklift vehicle.

FIG. 8 illustrates an alternative embodiment of the present invention which is based upon the same general concept as the embodiments illustrated in FIGS. 1–7. In FIG. 8, CLTM 10 is adapted for use as a forklift vehicle. This vehicle would be analogous to normal forklift trucks except that it rides on the ceiling instead of the floor.

The circulating latch system as shown in FIGS. 1–7 and described previously is applied to the overhead forklift vehicle of FIG. 8 thus defining the vehicle as moving in a two-dimensional direction with respect to overhead track system 17 consisting of parallel I-beams 12. Situated between and below the circulating latch mechanisms 14 are rotating joint 42, cab 44 in which an operator may sit, and forklift mechanism 46. Cab 44 and forklift mechanism 46 are similar to those on an ordinary forklift truck. Rotating joint 42 is designed to rotate or turn cab 44 and forklift mechanism 46 since CLTM 10 only moves the vehicle about by parallel translation and therefore cannot rotate. Since it would be desirable for the forklift vehicle to pick up and place skids or other objects in any orientation, rotating joint 42 is required for this movement. It is also preferable for cab 44 to face in a forward position during motion in order to give the operator a better view. The overhead forklift system is advantageous in that it avoids the use of floor space which can then be reserved for people, machines, storage and other vehicles. Although some floor space is still required by this vehicle for access aisles between rows of shelves, the space required is less than the space required by other forklift vehicles. Additionally, the overhead forklift vehicle is more maneuverable than conventional forklift trucks. This is made further apparent by the addition of a telescoping strut 48 attached to forklift mechanism 46. In this manner, only forklift mechanism 46 will be required to descend into the access aisles which results in the requirement for much narrower aisles and, hence, denser storage capacity. Further, the design of the overhead CLTM allows access to an electric power supply. In addition to aiding in the support of the vehicle in the vehicle's movement about track system 17, circulating latches 14 may also include electrical pickups to provide power to the vehicle. Although conventional forklift trucks commonly use propane fuel which is relatively pollution free, electrical power is still more pollution free. Finally, this inventive concept has certain safety advantages. For example, the operator can sit in a position of unobstructed view which would aid in avoiding potential pedestrian collisions.

The following description illustrates the application of a computer based control system for the CLTM. If desired, a CLTM may be modified to incorporate a computer based control system. The proposed computer based system allows one or more human operators to control a number of CLTM's operating concurrently in a given area. As shown in FIGS. 9 and 10, the system comprises time-shared computer 50, such as for example a PDP 11, and radio data link 52 which carries information between computer 50 andCLTM 10. Each CLTM 10 includes microprocessor 54 which communicates with main computer 50 and controls transverse motor 18 and longitudinal motors 55. The radio data link 52 shown in FIG. 10 will not impede or restrict the motion of the CLTM's 10 at all since it involves no loose cables or wires which could tangle together.

In order to the control system, the operators at the computer terminals type commands in a suitable high-level language. For example, an operator might type the command:

"Send a CLTM to transverse position 10, longitudinal position 42."

The computer would then locate an available CLTM 10 and choose a path for it on the overhead beam system which would avoid other CLTM's 10 and fixed obstacles. This planned path would then be transmitted to the chosen CLTM as a sequence of low level commands. The microprocessor in CLTM 10 would interpret these low level commands and actuate the longitudinal and transverse motors, enabling CLTM 10 to move along the assigned path.

It is understood that the control of motors by a microprocessor is well within the contemplation of one skilled in this art. Similarly, radio transmission of digital information is a common and well understood technique. It is to be further understood that this description is merely a brief summary of the computer commands which serves only for illustration purposes and is in no way intended to serve as a detailed description of the computer control system.

Although the present invention has been described with respect to specific features, embodiments and advantages, it is clear that a variety of such embodiments, features and advantages can be contemplated within the scope of the present invention.

What is claimed is:

1. A circulating latch transport system comprising at least one circulating latch transport mechanism for supporting apparata from a plurality of parallel beams, said system comprising means capable of moving said mechanism in a longitudinal direction, in a transverse direction and in a combination of both of said directions about said parallel beams, said transport mechanism including a plurality of trucks for moving said mechanism along said beams, said trucks being rotatable about the perimeter of each said circulating latch transport mechanism, said trucks together forming an endless, substantially flexible track system, said transport mechanism further comprising at least one drive motor, each of said trucks comrpising one pair of opposed jaws attached to said truck and means for selectively moving said jaws towards and away from each other as said trucks move transversely across said beams in order to thereby selectively engage and disengage said parallel beams.

2. A circulating latch transport system in accordance with claim 1 further comprising means for attaching said at least one circulating latch transport mechanism to said parallel beams.

3. A circulating latch transport system in accordance with claim 1 wherein said parallel beams are I-beams.

4. A circulating latch transport system in accordance with claim 2 wherein said parallel beams are adapted to be attached to the ceiling of a building.

5. A circulating latch transport system in accordance with claim 4 wherein said latch transport mechanism is attached to said beams.

6. A circulating latch transport system in accordance with claim 5 further comprising a plurality of wheels which are adapted to abut and roll along said parallel beams.

7. A circulating latch transport system in accordance with claim 6 wherein said transport mechanism includes a device for mvoing the transport mechanism along said parallel beams in a longitudinal direction along said parallel beams, said longitudinal moving device comprising wheels attached to said transport mechanism.

8. A circulating latch transport system in accordance with claim 5 wherein said transport mechanism includes a device for moving said mechanism in a transverse direction with respect to said parallel beams, said transverse moving device comprising said circulating latches.

9. A circulating latch transport system in accordance with claim 1 wherein said longitudinal moving means and said transverse moving means in combination comprise means for moving said transport mechanism in a plurality of predetermined directions with respect to said parallel beams.

10. A circulating latch transport system in accordance with claim 1 wherein said trucks are rotatable about the perimeters of said circulating latch mechanism and which comprise means for attaching said transport mechanism to said parallel beams, said transport mechanism further comprising at least one drive motor and beams which connect adjacent circulating latch mechanisms.

11. A circulating latch transport system in accordance with claim 10 wherein said jaws are operated by a cam system, said cam system comprising cam follower rollers and cam races, said cam follower rollers adapted to follow a path created by said cam races.

12. A circulating latch transport system in accordance with claim 1 wherein said transport mechanism comprises a crane.

13. A circulating latch transport system in accordance with claim 1 wherein said transport mechanism comprises a video camera carrier.

14. A circulating latch transport system in accordance with claim 1 wherein said transport mechanism comprises a mechanical manipulator arm.

15. A circulating latch transport system in accordance with claim 1 wherein said transport mechanism comprises a forklift.

16. A circulating latch transport system in accordance with claim 1 wherein said transport mechanism includes a computer based movement control system.

17. A circulating latch transport system in accordance with claim 1 wherein said transport system comprises a plurality of circulating latch transport mechanisms.

18. A circulating latch transport system in accordance with claim 17 wherein said transport mechanism includes a computer based system for simultaneously controlling the movement of a plurality of said circulating latch transport mechanisms.

19. A circulating latch transport system comprising at least one circulating latch transport mechansim for supporting overhead apparata from a plurality of parallel beams, said beams being annexed to an overhead structure, said transport mechanism comprising means capable of moving said mechanism in a longitudinal direction, in a transverse direction, and in a combination of both said directions about said parallel beams, said means for moving said transport mechanism about said parallel beams comprising a system of circulating latches, said circulating latches being attached to each other and comprising trucks which are rotatable about the perimeter of each said circulating latch mechanism and which together form an endless, flexible track system, said transport mechanism further comprising at least one drive motor which is connected to said circulating latch mechanism, said trucks each comprising first and second opposed jaws which move relative to one another to selectively engage and disengage individual ones of said parallel beams as said circulating latch mechanism moves in a direction transverse to said beams, wherein said trucks further comprise wheels for moving said mechanism in a longitudinal direction along said parallel beams.

20. A circulating latch transport system in accordance with claim 19 wherein said transport mechanism comprises a crane.

21. A circulating latch transport system in accordance with claim 19 wherein said transport mechanism comprises a video camera carrier.

22. A circulating latch transport system in accordance with claim 19 wherein said transport mechanism comprises a mechanical manipulator arm.

23. A circulating latch transport system in accordance with claim 19 wherein said transport mechanism comprises a forklift.

24. A circulating latch transport system comprising at least one circulating latch transport mechanism for supporting apparata froma plurality of parallel beams, said system comprising means capable of mvoing said mechanism in a longitudinal direction along said beams, in a transverse direction across said beams, and in a combination of both said directions about said parallel beams, said transport mechanism comprising a plurlaity of independently moveable trucks which are rotatable about the perimeter of said circulating latch transport mechanism and which together comrpise an endless, flexible truck system, said transport mechanism further comprising a drive motor connected to said circulating latch mechanism, wherein said trucks comprise jaws for attaching said mechanism to said parallel beams, said jaws being movable towards and away from each other by a cam system to selectively engage and disengage said beams by opening and closing about said beams, said cam system including cam following rollers and cam races, said cam following rollers being adapted to follow a path created by said cam races.

* * * * *

UNITED STATES PATENT AND TRADEMARK OFFICE

CERTIFICATE OF CORRECTION

PATENT NO. : 4,641,757

DATED : February 10, 1987

INVENTOR(S) : J. VAN ROSENDALE

It is certified that error appears in the above-identified patent and that said Letters Patent is hereby corrected as shown below:

In column 1, line 45 of the printed patent, change "flor-based" to ---floor-based---.

At column 1, line 52 of the printed patent, change "ona" to ---on a---.

At column 3, line 1 of the printed patent, change "shcematic" to ---schematic---.

At column 4, line 66 of the printed patent, change "320" to ---32 open---.

At column 7, line 5 of the printed patent (i.e., in claim 7, line 14), change "comrpising" to ---comprising---.

At column 7, line 28 of the printed patent (i.e., in claim 7, line 3), change "mvoing" to ---moving---.

At column 8, line 50 of the printed patent (i.e., claim 24, line 3), change "mvoing" to ---moving---.

UNITED STATES PATENT AND TRADEMARK OFFICE

CERTIFICATE OF CORRECTION

PATENT NO. : 4,641,757

DATED : February 10, 1987

INVENTOR(S) : J. VAN ROSENDALE

It is certified that error appears in the above-identified patent and that said Letters Patent is hereby corrected as shown below:

At column 8, line 57 of the printed patent (i.e., claim 24, line 11), change "comrpise" to ---comprise---.

Signed and Sealed this

Eighth Day of March, 1988

*Attest:*

DONALD J. QUIGG

*Attesting Officer*

*Commissioner of Patents and Trademarks*